US006898390B2

(12) United States Patent
Lee et al.

(10) Patent No.: US 6,898,390 B2
(45) Date of Patent: May 24, 2005

(54) POWER SUPPLY UNIT FOR A FUSING ROLLER OF AN ELECTROPHOTOGRAPHIC IMAGE FORMING APPARATUS

(75) Inventors: Kyung-woo Lee, Suwon (KR); Dong-woo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 37 days.

(21) Appl. No.: 10/120,410

(22) Filed: Apr. 12, 2002

(65) Prior Publication Data

US 2002/0176720 A1 Nov. 28, 2002

(30) Foreign Application Priority Data

May 25, 2001 (KR) ..... 2001-29005

(51) Int. Cl.[7] ..... G03G 15/00

(52) U.S. Cl. ..... 399/88; 219/216; 219/541; 399/330

(58) Field of Search ..... 399/88, 90, 320, 399/330, 335, 122; 219/216, 388, 469, 471, 541

(56) References Cited

U.S. PATENT DOCUMENTS

| | | | | | |
|---|---|---|---|---|---|
| 4,109,135 | A | * | 8/1978 | Minden et al. | 219/216 |
| 4,468,069 | A | * | 8/1984 | Meal et al. | 439/14 |
| 4,493,982 | A | * | 1/1985 | Romansky | 219/469 |
| 4,820,904 | A | * | 4/1989 | Urban | 219/216 |
| 5,283,619 | A | * | 2/1994 | Nomura et al. | 399/90 |
| 5,286,950 | A | * | 2/1994 | Sakata | 219/469 |
| 5,532,807 | A | * | 7/1996 | Takemoto | 399/335 |
| 5,987,296 | A | * | 11/1999 | Shimada et al. | 399/330 |
| 6,054,677 | A | * | 4/2000 | Morigami et al. | 219/216 |
| 6,151,465 | A | * | 11/2000 | Toba et al. | 399/90 |
| 6,255,632 | B1 | * | 7/2001 | Yokoyama et al. | 219/619 |
| 6,285,006 | B1 | * | 9/2001 | Hyllberg | 219/216 |
| 6,340,810 | B2 | * | 1/2002 | Yokoyama et al. | 219/619 |
| 6,571,080 | B2 | * | 5/2003 | Lee et al. | 399/330 |
| 6,594,455 | B2 | * | 7/2003 | Lee | 399/90 |

FOREIGN PATENT DOCUMENTS

| | | | | |
|---|---|---|---|---|
| JP | 05-303262 | | 11/1993 | |
| JP | 06-250551 | | 9/1994 | |
| JP | 08328417 | A * | 12/1996 | G03G/15/20 |
| JP | 10319756 | A * | 12/1998 | G03G/15/20 |
| JP | 11052773 | A * | 2/1999 | G03G/15/20 |

* cited by examiner

*Primary Examiner*—Robert Beatty
(74) *Attorney, Agent, or Firm*—Robert E. Bushnell, Esq.

(57) ABSTRACT

A power supply unit for a fusing roller of an electrophotographic image forming apparatus, which is electrically connected to a heat-generating portion for generating heat to raise the temperature of the fusing roller to an appropriate level at which a toner image is fused and for transmitting electric current from an external power source to the heat-generating portion, includes: a connecting portion installed at a center of each of two end caps fit around ends of the fusing roller and electrically connected to the heat-generating portion; a holder connected to the connecting portion, the holder installed in a frame, the frame supporting or mounting the fusing roller, and an elastic unit for providing elastic force to make the holder elastically contact the connecting portion. The power supply unit provides improved durability and operating safety under electrical and mechanical stresses caused by current, residual heat and thermal impacts.

19 Claims, 4 Drawing Sheets

POWER SUPPLY UNIT FOR A FUSING ROLLER OF AN ELECTROPHOTOGRAPHIC IMAGE FORMING APPARATUS

CLAIM OF PRIORITY

This application makes reference to, incorporates the same herein, and claims all benefits accruing under 35 U.S.C. § 119 from our application entitled A FIXING ROLLER POWER-SOURCE SUPPLY APPARATUS OF ELECTROPHOTOGRAPHIC IMAGE FORMING APPARATUS filed with the Korean Industrial Property Office on May 25, 2001 and there duly assigned Ser. No. 29005/2001.

BACKGROUND OF THE INVENTION

1. Field of the Invention

The present invention relates to a power supply unit for a fusing roller of an electrophotographic image forming apparatus, and, more particularly, to a power supply unit for a fusing roller of an electrophotographic image forming apparatus with improved durability and operating safety.

2. Description of the Related Art

In a general electrophotographic image forming apparatus adopting an electrostatic development technique, such as a photocopy machine or a laser printer, an electrostatic charging roller adjacent to a photoreceptor drum charges a photosensitive material coated on the surface of the photoreceptor drum while rotating around the photoreceptor drum. The charged photoreceptor material is exposed to a laser beam emitted from a laser scanning unit (LSU) so that a latent electrostatic image is formed in an intended pattern on the photosensitive material. A developer unit supplies toner to the photosensitive material to develop the latent electrostatic image formed thereon into a visible toner image. A predetermined transfer voltage is applied to the photoreceptor drum having the toner image and a transfer roller is put in contact with the photoreceptor drum by a predetermined force. In this state, as a print paper is fed in the gap between the transfer roller and the photoreceptor drum, the developed toner image on the photoreceptor drum is transferred to the print paper.

A fixing unit including a fusing roller instantaneously heats the print paper to which the toner image is transferred, to fuse and fix the toner image to the print paper. The surface of the fusing roller is heated to a predetermined temperature by radiant heat generated by a heat source of the fixing unit. The heat source of the fixing unit is connected with an external power source and generates radiant heat from an electric current supplied from the external power source.

A direct surface heating roller apparatus includes a heating roller that includes a roller body, an insulating layer coated on the roller body, a resistive heating layer coated around the insulating layer for generating heat, a protective layer formed on the resistive heating layer, and a power supply unit. The power supply unit is formed as a slip ring to fit around the heat-generating layer and is fixed in position with a conductive adhesive. The slip ring transfers electric current applied from the external power source to the heat-generating layer while rotating along with the roller body.

For the power supply unit of the direct surface heating roller apparatus described above, the resistive heating layer is formed in contact with the surface of the roller body and the slip ring fits around the resistive heating layer by spreading the conductive adhesive on the resistive heating layer. Thus, there can be a problem in that the power supply unit is subjected to electrical and mechanical stresses caused by electric current and residual heat, and thermal impacts that can occur depending on user circumstances. Because there is a need to raise the temperature of the heating roller apparatus to a high temperature within a short period of time, the power supply unit can experience repetitive thermal impacts in the initial operating stage and during normal operation. As a result, there can be a risk of electrical sparking and, thus, satisfactory durability and operating safety can be adversely affected. In addition, due to use of the conductive adhesive, it is likely that electric current will flow through components other than the resistive heating layer and, thus, a user possibly could get shocked.

Therefore, there is a need to ensure increased safety in operating the fusing roller unit using a heat pipe with a power supply unit differing from that typically used for a direct surface heating roller apparatus.

SUMMARY OF THE INVENTION

To address the above-described needs, it is an object, among other objects, of the present invention to provide a power supply unit for a fusing roller of an electrophotographic image forming apparatus with an improved structure to ensure durability and safety during operation.

To achieve the object, and other objects, of the present invention, there is provided a power supply unit for a fusing roller of an electrophotographic image forming apparatus, which is electrically connected to a heat-generating portion for generating heat to raise the temperature of the fusing roller to an appropriate level at which a toner image is fused and transmits electric current from an external power source to the heat-generating portion, the power supply unit including: a connecting portion installed at the center of each of two end caps fit or positioned around ends of the fusing roller and electrically connected to the heat-generating portion; a holder installed in a frame to which the fusing roller is mounted, and the holder being connected to the connecting portion, and an elastic means for providing an elastic force, the elastic force for making the holder elastically contact the connecting portion.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
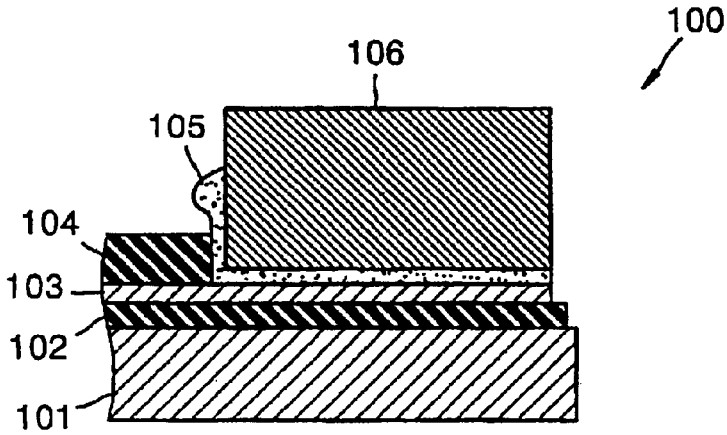
FIG. 1 is a sectional view of a direct surface heating roller apparatus exemplary of contemporary practice in the art.

FIG. 1 is a sectional view of a direct surface heating roller apparatus exemplary of contemporary practice in the art. Referring to FIG. 1, the heating roller 100 includes a roller body 101, an insulating layer 102 coated on the roller body 101, a resistive heating layer 103 coated around the insulating layer 102 for generating heat, a protective layer 104 formed on the resistive heating layer 103, and a power supply unit 106.

The power supply unit 106 is formed as a slip ring to fit around the heat-generating resistive heating layer 103 and is fixed in position with a conductive adhesive 105. The slip ring of the power supply unit 106 transfers electric current applied from an external power source to the heat-generating resistive heating layer 103 while rotating along with the roller body 101.

For the power supply unit 106 of the direct surface heating roller apparatus described above, the resistive heating layer 103 is formed in contact with the surface of the roller body 101 and the slip ring of the power supply unit 106 fits around the resistive heating layer 103 by spreading the conductive adhesive 105 on the resistive heating layer 103.

However, there can be a problem in that the power supply unit 106 illustrated in FIG. 1 can be subjected to electrical and mechanical stresses caused by an electric current and residual heat, and thermal impacts can occur depending on user circumstances. Because there is a need to raise the temperature of the heating roller apparatus corresponding to FIG. 1 to a high temperature within a short period of time, the power supply unit 106 can experience repetitive thermal impacts in the initial operating stage and during normal operation. As a result, there can be a risk of electrical sparking and, therefore, satisfactory durability and operating safety can be affected. In addition, due to use of the conductive adhesive 105, it is likely that electric current can flow through components other than the resistive heating layer and, thus, a user possibly could get shocked.

Figure 2:
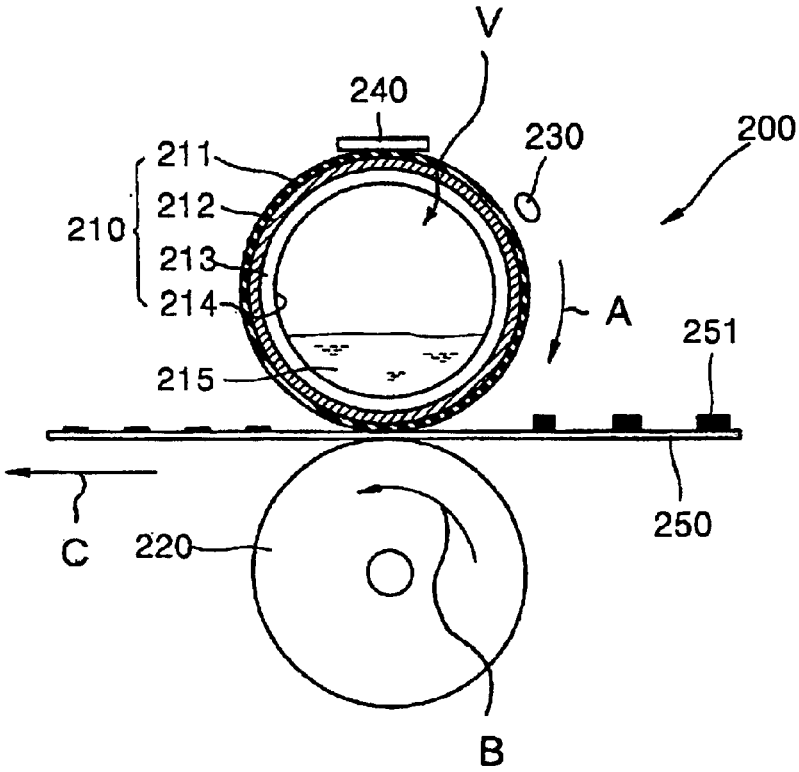
FIG. 2 is a sectional view of a fixing unit of an electrophotographic image forming apparatus employing a power supply unit for a fusing roller according to a preferred embodiment of the present invention.

Therefore, in view of the above-described needs, a fixing unit of an electrophotographic image forming apparatus employing a power supply unit for a fusing roller according to the present invention is shown in FIG. 2. As shown in FIG. 2, a fixing unit 200 includes a fusing roller unit 210 which rotates in a direction in which a printing medium, such as a print paper 250, having a toner image 251 thereon is ejected, i.e., in a clockwise direction in FIG. 2 illustrated by the arrow A, and a pressure roller 220 which is installed beside the fusing roller unit 210 with the print paper 250 therebetween and rotates, for example, in a counterclockwise direction, illustrated by the arrow B in FIG. 2, in contact with the fusing roller unit 210 to eject the print paper 250 in the direction of the arrow C in FIG. 2.

Continuing with reference to FIG. 2, the fusing roller unit 210 includes a cylindrical fusing roller 212 on which a protective layer 211 is coated, such as with Teflon, and a heat-generating portion 213 installed in the fusing roller 212 for generating heat from an electric current applied from a power supply unit 300 (see FIG. 3) for the fusing roller 212. The fusing roller unit 210 also includes an internal pipe 214 which is installed in the heat-generating portion 213 and is sealed at its ends to maintain a predetermined internal pressure. A predetermined fraction of the volume V of the inner pipe 214 is filled with a working fluid 215.

As illustrated in FIG. 2, a thermistor 240 is mounted on the top of the fusing roller 212 in contact with the protective layer 211 to sense the surface temperature of the fusing roller 212 and the protective layer 211. A thermostat 230 is also installed around the fusing roller 212 to cut off the supply of power from the power supply unit 300 (see FIG. 3) when the thermistor 240 does not provide an accurate temperature detection and the surface temperature of the fusing roller 212 and the protective layer 211 suddenly rise to or above a predetermined surface temperature.

The heat-generating portion 213, as illustrated in FIG. 2, which generates heat from electric current supplied by the power supply unit 300 (see FIG. 3), is preferably formed of a spiral resistive heating coil C (see FIG. 3) to contact both the inside of the fusing roller 212 and the outside of the inner pipe 214. The resistive heating coil C includes a heating wire W formed of a nickel-chromium coil C1 and a coating or covered layer C2 formed around the coil C1 of the heating wire W for protection. An insulating layer C3 is interposed between the coil C1 of the heating wire W and the coated layer or covered layer C2. The insulating layer C3 is preferably formed of magnesium oxide (MgO), for example.

Figure 3:
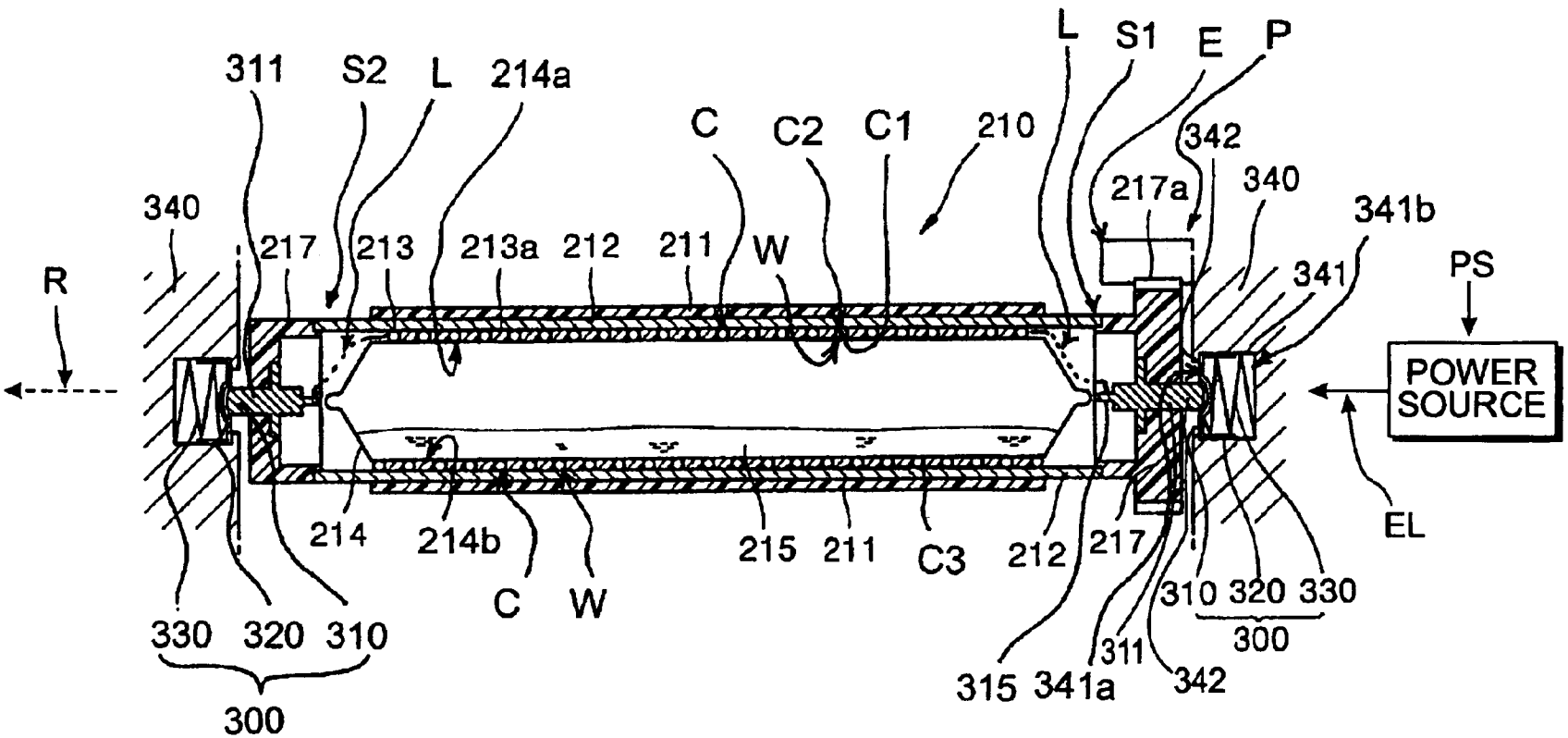
FIG. 3 is a longitudinal sectional view of a fusing roller unit for the fusing roller for the fixing unit of FIG. 2 to which the power supply unit according to the present invention is mounted.

As shown in FIG. 3, which is a longitudinal sectional view of the fusing roller unit 210 of FIG. 2 to which the power supply unit 300 for a fusing roller 212 according to the present invention is mounted, a heat carrier 213*a* is formed in the space of the spiral resistive heating coil C. The heat carrier 213*a* transmits heat generated directly from the heat-generating portion 213 and heat of the internal pipe 214 to the fusing roller 212. Heat transmission capability is improved by the heat carrier 213*a*, compared to when heat is transmitted by only the heat-generating portion 213*a*. Therefore, the temperature of the entire fusing roller 212 can uniformly rise to a target temperature. The heat carrier 213*a* is formed of a material having good thermal conductivity, and preferably, of aluminum (Al), for example.

The inner pipe 214 is sealed at both ends and a working fluid 215 is contained therein. Preferably, the inner surface or wall 214*a* of the inner pipe 214 has a meshed structure. This is for uniform transfer of heat generated from the heat-generating portion 213 over the entire inner pipe 214 as quickly as possible. It will be appreciated that the inner pipe 214 can have various structures for uniform heat transfer through the inner pipe 214.

As the working fluid 215 vaporizes due to heat generated from the heat-generating portion 213, the heat from the heat-generating portion 213 is transferred to the fusing roller 212. The working fluid 215 serves as a heat transfer medium for preventing a deviation in surface temperature of the fusing roller 212 and uniformly heating the fusing roller 212 within a short period of time. To perform this function, the working fluid 215 occupies from about 5% to about 50%, and preferably, from about 5% to about 15% of the total volume of the inner pipe 214. If the amount of working fluid 215 is less than about 5% by volume, an undesirable dry-out phenomenon in which the working fluid 215 does not fully liquefy and vaporizes immediately after liquification is likely to occur.

Continuing with reference to FIG. 3, end caps 217 are fit on both ends of the fusing roller 212. A power transmission device P coupled to an electromotor E installed in a frame 340 for holding or supporting the fusing roller unit 210 is fit around one of the end caps 217. Preferably, the power transmission device P formed around the surface 217*s* of one of the end caps 217 has a gear tooth 217*a* engaged with the electromotor E to rotate the fusing roller unit 210.

Also, as illustrated in FIG. 3, the power supply unit 300 for the fusing roller 212 is installed on one side, S1 or S2, or on each side, S1 and S2, of the fusing roller 212 and transmits electric current EL from an external power source PS to the heat-generating portion 213. The power supply unit 300 includes a connecting portion 310, a holder 320, and an elastic means 330.

Figure 4:
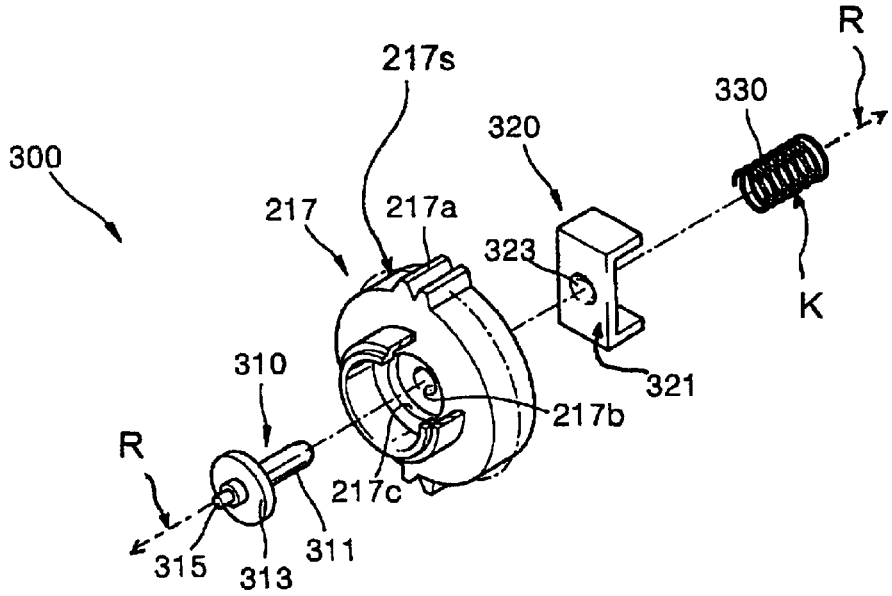
FIG. 4 is an exploded perspective view of the power supply unit of FIG. 3.

FIG. 4 is an exploded perspective view of the power supply unit 300 of FIG. 3. As shown in FIG. 4, the connecting portion 310 is inserted through a through hole 217*b* located at the center of the end cap 217, i.e., on the axis of rotation R of the fusing roller 212 and the fusing roller unit 210. The connecting portion 310 has a flange 313 to be fit in a dent 217*c* formed around the through hole 217*b* of the end cap 217. The connecting portion 310 has a first connector 311 at one side of the flange 313, which is a protrusion to be coupled with the holder 320, and a second connector 315 at the other side of the flange 313, which is to be connected to a lead wire L of the resistive heating coil C of the heat-generating portion 213. The connection between the second connector 315 and a lead wire L of the resistive heating coil C is diagrammatically illustrated in FIG. 3, and this connection of the lead wire L and the second connector 315 and to the resistive heating coil C can easily be implemented by one skilled in the art.

Continuing with reference to FIGS. 3 and 4, preferably, the flange 313 is press fit into the dent 217*c*. In this case, even when the holder 320 pushes the connecting portion 310 toward the inner pipe 214 by elastic force from the elastic means 330, the connecting portion 310 can be kept in the dent 217*c* without being pushed toward the inner pipe 214, because the flange 313 of the connecting portion 310 is tightly fit in the dent 217*c*.

Again referring to FIGS. 3 and 4, the holder 320 is installed in the frame 340, as illustrated in FIG. 3. The holder 320 is connected to the first connector 311 of the connecting portion 310 and transmits the electric current EL to, or from, the connecting portion 310 through the first connector 311. The holder 320 includes a plate or planar shaped portion 321 and a recession 323 at the center of the plate or planar shaped portion 321, i.e., on the axis of rotation R of the fusing roller 212 and the fusing roller unit 210. The first connector 311 of the connecting portion 310 is made to contact the recession 323.

The frame 340 has an aperture 341 having one end 341*a* open near the fusing roller unit 210 and the other end 341*b* closed, and a plurality of retaining members 342. The holder 320 is inserted into the aperture 341 and tightly kept therein by the retaining members 342. The holder 320 is formed of a conductive material and the electric current EL flows along the holder 320 in connection with the external power source PS.

Figure 6:
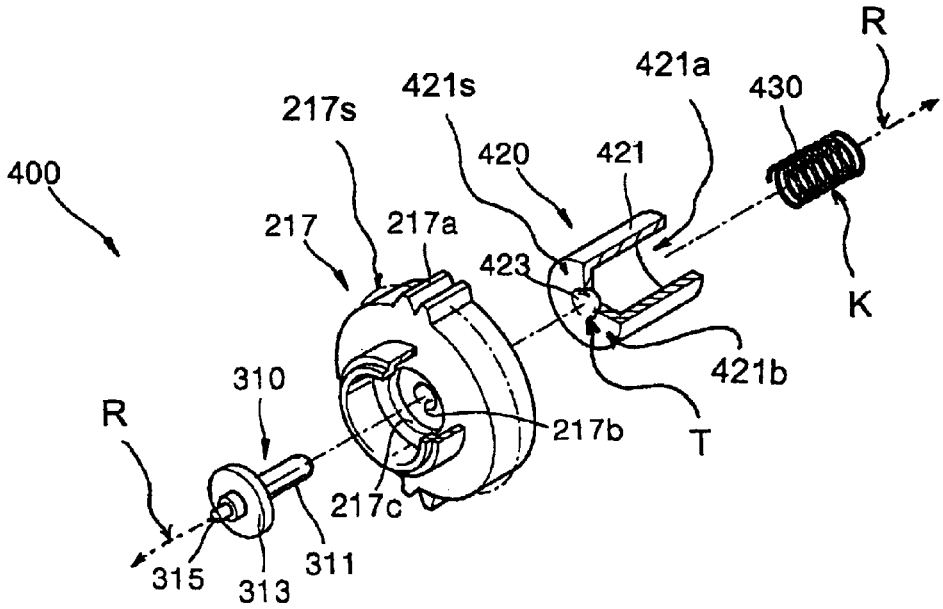
FIG. 6 is an exploded perspective view of the power supply unit of FIG. 5.
Figure 5:
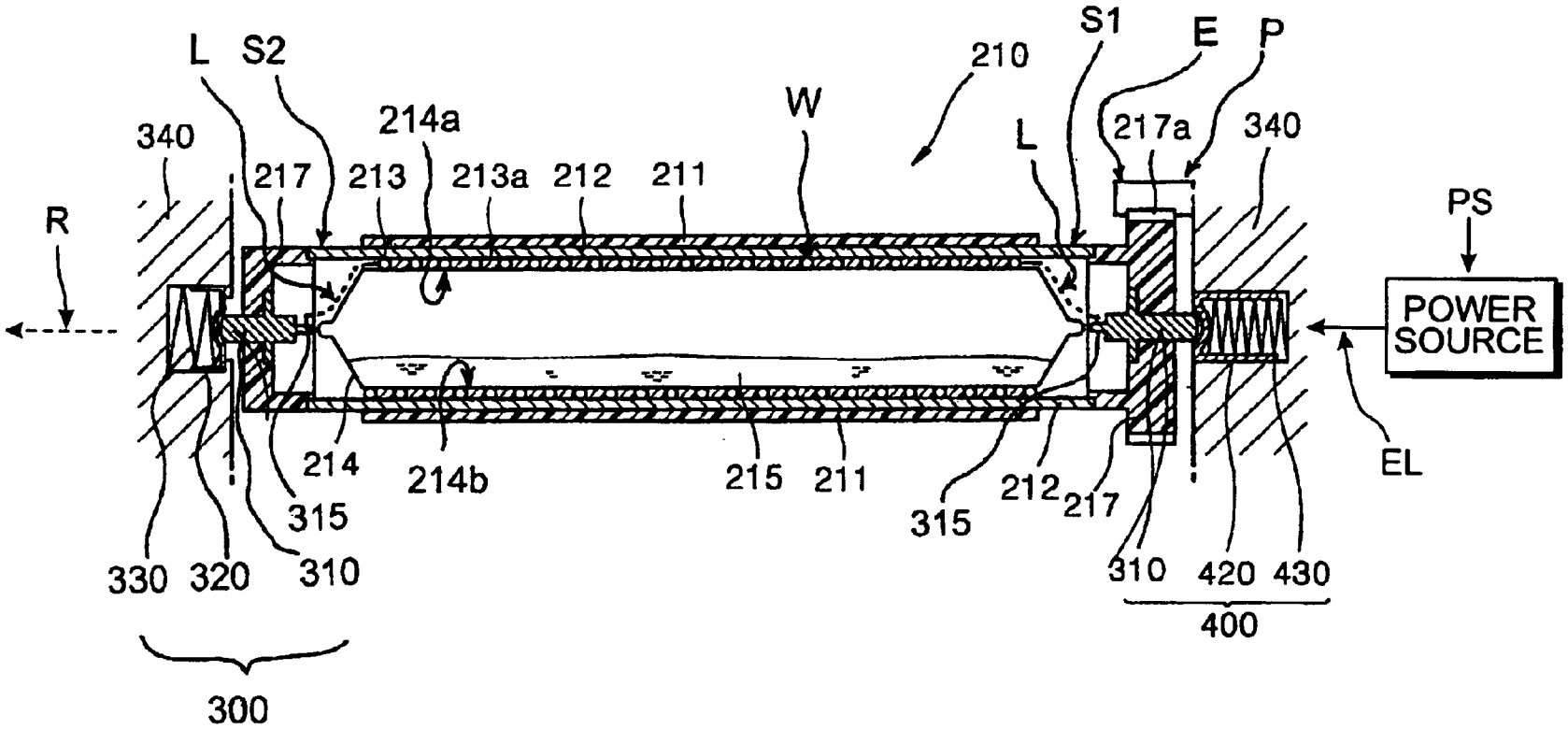
FIG. 5 is a longitudinal sectional view of a fusing roller unit for the fusing roller for the fixing unit of FIG. 2 to which an alternative embodiment example of a power supply unit according to the present invention is mounted.

Referring now to FIGS. 5 and 6, FIG. 5 is a longitudinal sectional view of a fusing roller unit 210 employing an alternative example of the power supply unit 400 for a fusing roller 212 according to the present invention and FIG. 6 is an exploded perspective view of the power supply unit 400 of FIG. 5. In FIGS. 5 and 6, elements having the same functions as those of FIGS. 3 and 4 are represented by the same reference numerals as used in FIGS. 3 and 4.

Referring to FIGS. 5 and 6, the fusing roller unit 210 has the same structure as that of FIG. 3 and the shape of a holder 420 fit into the frame 340 differs from that of FIG. 3. The holder 420 has a cylindrical body 421 having one end 421*a* open and the other end 421*b* closed and a recession 423, which is made to contact the first connector 311 of the connecting portion 310, and which is formed at the center T of the outer surface 421*s* of the closed end 421*b* of the cylindrical body 421, i.e., on the axis of rotation R of the fusing roller 212 and the fusing roller unit 210. An elastic means 430 is inserted into the holder 420 through the open end 421*a* of the cylindrical body 421.

The elastic means 330 and 430 of FIGS. 4 and 6, respectively, push the holders 320 and 420, respectively, toward the fusing roller unit 210 to allow the holders 320 and 420 to respectively contact the first connector 311 of the connecting portion 310. In the present invention, a compressed coil spring K is used as the elastic means 330 and 430, for example. However, the elastic means is not limited to the compressed coil spring K and can be modified into various forms as long as it performs the same or similar function of the compressed coil spring K in accordance with the present invention.

The operation of a fusing roller unit 210 having the structure described above with a respective power supply unit 300, 400 for a fusing roller 212 according to the present invention will now be described.

Referring to FIGS. 2 through 4 and to FIGS. 5 and 6, as the electromotor E installed in the frame 340 rotates in gear with the gear tooth 217*a* formed along the outer surface 217*s* of the end cap 217, the fusing roller 212 coupled to the end cap 217 starts to rotate. At this time, the pressure roller 220 installed facing the fusing roller unit 210 with the print paper 250 therebetween rotates in the opposite direction B to the rotation A of the fusing roller 212 and the fusing roller unit 210.

The connecting portion 310 fitted to the end cap 217 rotates along with the end cap 217 while the first connector 311 of the connecting portion 310 is in contact with the respective holder 320, 420. At this time, the respective holder 320, 420 is pushed close to the first connector 311 by the respective elastic means 330, 430 and thus the first connector 311 is kept in contact with the respective holder 320, 420. As a result, current supply of the electric current EL to the heat generating portion 213 for the fusing roller 212 is not interrupted during operation.

In order to fuse and fix the toner image 251, which is formed of toner particles, to the print paper 250, there is a need to raise the temperature of the fusing roller 212 to an appropriate level. To this end, the electric current EL supplied from the external power source PS flows through the respective holder 320, 420, the connecting portion 310 contacting the respective holder 320, 420, and then the heat-generating portion 213 contacting the connecting portion 310.

When the electric current EL is supplied to the heat-generating portion 213, the heat-generating potion 213 generates resistance heat. A portion of the generated resistance heat is transmitted to the fusing roller 212 and the remaining portion is transmitted to the inner pipe 214. The inner surface 214*a* of the inner pipe 214 has a meshed structure and thus heat can be transmitted through the inner pipe 214 within a short period of time. The working fluid 215 contained in the inner pipe 214 is heated and evaporates. The heat energy of the working fluid 215 in the gas state is transmitted to the fusing roller 212 through the heat carrier 213*a* formed on the outer surface 214*b* of the inner pipe 214.

As a result, the heat generated by the heat-generating portion 213 is directly transmitted and the heat of the working fluid 215 is transmitted through the heat carrier 213*a* to the fusing roller 212. Thus, the surface temperature of the fusing roller 212 reaches a target fusing temperature at which the toner image 251 on the printer paper 250 can be fused, within a shorter period of time by uniform heat transmission over the fusing roller 212. The toner image 251 formed on the print paper 250 fed between the fusing roller unit 210 and the pressure roller 220 is heated, fused, and fixed on the printer paper 250 by the fusing roller 212 heated to the target fusing temperature.

As the heat of the fusing roller 212 is taken or used by fusing of the toner image 251, the vaporized working fluid 215 changes back into the liquid state in the inner pipe 214. However, due to continuous heating of the inner pipe 214 by the heat-generating portion 213, in view of the electric current EL supplied from the respective power supply unit 300, 400 to the heat generating portion 213, the working fluid 215 immediately vaporizes, thereby raising the surface temperature of the fusing roller 212 to the target fusing temperature. Thus, advantageously, continuous printing is possible using the respective power supply unit 300, 400 of the present invention.

As described above, the power supply unit for a fusing roller of an electrophotographic image forming apparatus according to the present invention, such as the power supply units 300 and 400, provides improved durability and operating safety, when compared to, for example, a power supply unit for a fusing roller which rotates along with the fusing roller and to which electrical and mechanical stresses, such as caused by current, residual heat and thermal impacts, depending on user circumstances, are continuously and repeatedly applied to such power supply unit for a fusing roller.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A fusing roller assembly, comprising:

a cylindrical, hollow outer roller;

an inner roller inserted into the outer roller;

a resistive coil wound around the inner roller to generate heat when power is applied thereto;

a first end cap made of a non-conductive material, the first end cap being fitted to an end of the outer roller;

a second end cap made of a non-conductive material, the second end cap being fitted to the other end of the outer roller;

a first conductive electrode positioned by said first end cap spaced radially apart from said outer roller while connected to an end of the resistive coil; and a second conductive electrode positioned by said second end cap spaced radially apart from said outer roller while connected to the other end of the resistive coil.

2. The fusing roller assembly of claim 1, comprised of said resistive coil forming a spiral winding contacting both an interior surface of said outer roller and an exterior surface of said inner roller.

3. The fusing roller assembly of claim 1, comprised of:

said first end cap being perforated by a through-hole extending along an axis of rotation of said outer roller; and said first conductive electrode extending through said through-hole.

4. The fusing roller assembly of claim 1, comprising said first conductive electrode perforating said first end cap along an axis of rotation of said fusing roller assembly.

5. The fusing roller assembly of claim 1, comprising:

said first conductive electrode extending axially through said first end cap along an axis of rotation of said fusing roller assembly; and a holder engaging a distal end of said first conductive electrode while urging said first conductive electrode to maintain electrical contact with said resistive coil.

6. An electrophotographic image forming apparatus, comprising:

a fusing roller assembly comprising:

a cylindrical, hollow outer roller;

an inner roller inserted into the outer roller;

a resistive coil wound around the inner roller to generate heat when power is applied thereto;

a first end cap made of a non-conductive material, the first end cap being fitted to an end of the outer roller;

a second end cap made of a non-conductive material, the second end cap being fitted to the other end of the outer roller;

a first conductive electrode positioned substantially at the center of the first end cap and connected to an end of the resistive coil; and a second conductive electrode positioned substantially at the center of the second end cap and connected to the other end of the resistive coil;

a rotary member which rotates the fusing roller assembly;

main body first and second electrodes installed on a main body of the electrophotographic image forming apparatus and contacting the respective first and second conductive electrodes of the fusing roller assembly; and first and second spring members which push the main body first and second electrodes against the first and second electrodes of the fusing roller assembly, wherein power is supplied to the fusing roller assembly in a state where the fusing roller assembly is rotated so that the first and second electrodes are pushed against the main body first and second electrodes by the first and second spring members.

7. The apparatus of claim 6, comprised of said resistive coil forming a spiral winding contacting both an interior surface of said outer roller and an exterior surface of said inner roller.

8. The apparatus of claim 6, comprised of:

said first end cap being perforated by a through-hole extending along an axis of rotation of said outer roller; and said first conductive electrode extending through said through-hole.

9. The apparatus of claim 6, comprising said first conductive electrode perforating said first end cap along an axis of rotation of said fusing roller assembly.

10. The apparatus of claim 6, comprised of said first conductive electrode being held by said first end cap while extending axially through said first end cap along an axis of rotation of said outer roller.

11. An electrophotographic image forming apparatus, comprising:

a fusing roller assembly including:

a cylindrical fusing roller with two open ends;

a heater installed in the fusing roller;

end caps made of a non-conductive material, the end caps being fitted to the ends of the fusing roller to prevent air flow in the fusing roller for higher heat retention;

conductive electrodes inserted through the centers of the end caps, through which power is supplied to the heater;

a rotary member which rotates the fusing roller assembly;

main body conductive electrodes installed on a main body of the electrophotographic imaging forming apparatus and contacting the respective conductive electrodes of the fusing roller assembly; and spring members which push the main body conductive electrodes against the conductive electrodes of the fusing roller assembly, wherein power is supplied to the fusing roller assembly in a state where the fusing roller assembly is rotated so that the conductive electrodes are pushed against the main body conductive electrodes by the spring members.

12. The apparatus of claim 11, comprising said heater forming a coil wound in a spiral positioned axially between said open ends, and contacting an interior surface of said fusing roller.

13. The apparatus of claim 11, comprising:

said heater forming a coil wound in a spiral between said open ends against an interior surface of said fusing roller; and one of said conductive electrodes being press fit into one of said end caps while passing axially through said one of said caps along an axis of rotation of said fusing roller.

14. A fusing roller assembly, comprising:

a cylindrical, hollow outer roller;

a thermally conducting inner roller inserted into the outer roller, an electrically resistive coil wound around an exterior surface of said inner roller, between said outer roller and said inner roller;

a first end cap made of a non-electrically conductive material, bearing an peripheral array of teeth, operationally transferring rotational energy from said teeth to said outer roller while plugging one base of said outer roller;

a second end cap made of a non-electrically conductive material disposed axially opposite from said first end cap, plugging a second base of said outer roller;

a first conductive electrode positioned by said first end cap spaced radially apart from said outer roller while extending through said first end cap and electrically connecting with a terminal end of the resistive coil; and a second conductive electrode positioned by said second end cap spaced radially apart from said outer roller while electrically connected with another end of the resistive coil.

15. The apparatus of claim 14, with said coil wound in a spiral positioned axially between said first base and said second base, thermally contacting an interior surface of outer roller.

16. The apparatus of claim 14, comprising:

said coil wound in a spiral between said first base and said second base and an interior surface of said outer roller; and one of said first and said second conductive electrodes being held by one of said first and said second end caps while passing axially through said one of said caps along an axis of rotation of said fusing roller.

17. A fusing roller assembly, comprising:

a cylindrical, hollow outer roller;

a thermally conducting inner roller inserted into the outer roller;

an electrically resistive coil wound between an interior surface of said outer roller and an exterior surface of said inner roller;

a first end cap made of a non-electrically conductive material operationally transferring rotational energy to said outer roller while plugging one base of said outer roller;

a second end cap made of a non-electrically conductive material disposed axially opposite from said first end cap, plugging a second base of said outer roller;

a first conductive electrode positioned by said first end cap spaced radially apart from said outer roller while extending through said first end cap and electrically connecting with a terminal end of the resistive coil; and a second conductive electrode positioned by said second end cap spaced radially apart from said outer roller while electrically connected with another end of the resistive coil.

18. The apparatus of claim 17, with said coil wound in a spiral positioned axially between said first base and said second base, thermally contacting said interior surface of outer roller.

19. The apparatus of claim 17, comprising:

said coil wound in a spiral between said first base and said second base around an exterior surface of said inner roller; and one of said first and said second conductive electrodes being held by one of said first and said second end caps while passing axially through said one of said caps along an axis of rotation of said fusing roller.

* * * * *